United States Patent [19]

Yuvancic

[11] Patent Number: 4,765,407

[45] Date of Patent: Aug. 23, 1988

[54] METHOD OF PRODUCING GAS CONDENSATE AND OTHER RESERVOIRS

[75] Inventor: James A. Yuvancic, Tyler, Tex.

[73] Assignee: Amoco Corporation, Chicago, Ill.

[21] Appl. No.: 902,247

[22] Filed: Aug. 28, 1986

[51] Int. Cl.[4] ..... E21B 43/40

[52] U.S. Cl. ..... 166/268; 166/266; 166/305.1; 405/128; 423/574 R

[58] Field of Search ..... 166/266, 267, 268, 273, 166/274, 305.1, 75.1; 405/128; 423/220, 574 R

[56] References Cited

U.S. PATENT DOCUMENTS

| | | | |
|---|---|---|---|
| 2,623,596 | 12/1952 | Whorton et al. | 166/266 X |
| 2,720,265 | 10/1955 | Tracht | 166/266 |
| 3,249,157 | 5/1966 | Brigham et al. | 166/273 |
| 3,845,196 | 10/1974 | Rhoades | 166/267 X |
| 4,085,199 | 4/1978 | Singleton et al. | 423/574 R |
| 4,344,486 | 8/1982 | Parrish | 166/266 X |
| 4,353,418 | 10/1982 | Hoekstra et al. | 166/267 X |
| 4,382,912 | 5/1983 | Madgavkar et al. | 166/266 X |
| 4,425,317 | 1/1984 | Zeller et al. | 423/574 R |
| 4,507,275 | 3/1985 | Reed | 423/574 R |
| 4,548,267 | 10/1985 | Sheffield et al. | 166/268 |

*Primary Examiner*—George A. Suchfield
*Attorney, Agent, or Firm*—L. Wayne White

[57] ABSTRACT

A reservoir is produced by injecting a mixture of carbon dioxide and nitrogen produced by treatment of a Claus plant gaseous effluent stream into the reservoir to enhance production.

5 Claims, 3 Drawing Sheets

EQUILIBRIUM PHASE DISTRIBUTION VERSUS PRESSURE

EQUILIBRIUM PHASE DISTRIBUTION VERSUS PRESSURE

METHOD OF PRODUCING GAS CONDENSATE AND OTHER RESERVOIRS

FIELD OF THE INVENTION

The present invention relates to a method of producing a subterranean reservoir and in a particular aspect to a method of producing a retrogade gas condensate reservoir.

SETTING OF THE INVENTION

High pressure reservoirs having pressures of 1500 psia or greater can include gas condensate reservoirs as well as reservoirs capable of production by miscible flooding. In the case of the gas condensate reservoir, gases such as nitrogen can be injected to maintain pressure in the reservoir to prevent or minimize condensate formation. In the case of miscible flooding, gases such as nitrogen or carbon dioxide can be injected into the reservoir above the appropriate miscibility pressure to increase the production of oil through the formation of a mobile solvent-oil bank. Gas condensate reservoirs by their nature typically have pressures of 5000 psia or greater. Further, high pressure reservoirs producible by nitrogen miscible flooding typically require high pressures, for example, 5000 psia or greater whereas reservoirs produced by $CO_2$ miscible flooding are typically characterized by less than 2000 psia pressure. In the case of immiscible displacement flooding, both nitrogen and carbon dioxide can be used at lower pressures, for example, down to 500 psia or less. In all cases, a suitable source of gas is required which can be provided, for example, by a dedicated plant such as a nitrogen plant, or by pipeline from a suitable source.

Gas condensate reservoirs are increasingly important in the production of hydrocarbon fluids. In these reservoirs, the in-place fluids can either be one phase or two phase (gas and liquid) depending on both the pressure and the temperature of the reservoir. As the reservoir fluid pressure declines because of production, the composition of the produced fluids remains constant until the saturation dewpoint pressure is reached, below which liquid condenses out of the reservoir fluid which results in an equilibrium gas phase with a lower liquid content. The condensed liquid is immobile within the formation until its saturation in the pore spaces exceeds that required for fluid flow, as governed by the specific oil-gas relative permeabilities of the reservoir rock. The gas produced at the surface will then have a lower liquid content and this process, which is called "retrograde condensation," will continue until a point of maximum liquid volume in the reservoir is reached. The term "retrograde" is used because the condensation of the liquid from a gas in such a reservoir is associated with decreasing pressure, rather than increasing pressure, as is the case at low pressures. Further, as used herein, a retrograde gas-condensate reservoir is synonymous with a gas condensate reservoir.

Because gas condensate reservoirs can as indicated exhibit retrograde condensation phenomena when subjected to pressure depletion, the optimal production of hydrocarbon liquid requires maintaining reservoir pressure at or above the saturation dewpoint pressure. Once the reservoir is depleted below the saturation dewpoint pressure, the volume of retrograde liquid condensed out of the reservoir gas is often lost to primary production. Recovery of these volumes then requires additional advanced techniques and even with such techniques recovery may only be partial at best.

A conventional pressurizing gas such as nitrogen can prevent retrograde condensation of the original reservoir fluid but such a gas can raise the saturation dewpoint pressure of the overall mixture as compared to the gas-in-place. Thus, fluid contaminated with pressurizing gas falls below its saturation dewpoint pressure and some loss of retrograde liquid occurs. Such loss typically is limited to the transition region where reservoir fluid and pressurizing gas mix. Although not as serious as the potentially formation-wide loss characteristic of pressure depletion, this retrograde liquid loss is still substantial.

SUMMARY OF THE INVENTION

According to an aspect of the present invention, pressure is maintained in a gas condensate reservoir by adding a mixture comprising predominantly carbon dioxide and nitrogen. As indicated below, equation-of-state calculations show that addition of carbon dioxide to nitrogen leads to saturation dewpoint pressure depression, thus suppressing retrograde condensation in all regions of a reservoir. Moreover, for the case of depletion below the saturation dewpoint pressure prior to pressure maintenance, where condensation may have already occurred, the presence of carbon dioxide can promote revaporization by virtue of its superior solubilization of hydrocarbons.

In accordance with the invention, there is provided a process for producing a reservoir. The reservoir can either be a gas condensate reservoir or a high pressure reservoir to be produced by miscible flooding or a reservoir to be produced by immiscible displacement flooding. In accordance with the invention, a Claus plant effluent stream is produced which comprises predominantly carbon dioxide, nitrogen, and water, and minor amounts of hydrogen sulfide and sulfur dioxide. The Claus plant effluent stream is produced from a gaseous stream comprising hydrogen sulfide and carbon dioxide by the steps of oxidizing a portion of the hydrogen sulfide to sulfur dioxide and reacting thus produced sulfur dioxide with a remaining portion of hydrogen sulfide and producing elemental sulfur which is condensed and removed. The resulting Claus plant effluent stream is then subjected to a hydrogenation treatment in which substantially all sulfur species in the resulting Claus plant effluent stream are hydrogenated to hydrogen sulfide. Water is then removed from the resulting hydrogenated stream. The resulting dried hydrogenated stream is then pressurized to a suitable reservoir injection pressure, and the resulting pressurized dried hydrogenated stream is injected into the reservoir.

In accordance with further aspects of the invention, the reservoir is a gas condensate reservoir having a pressure of 5000 psia or greater and the process comprises injecting the resulting pressurized dried hydrogenated stream into the gas condensate reservoir and maintaining pressure above the saturation dewpoint pressure therein.

In accordance with a further aspect of the invention, the high pressure reservoir comprises a reservoir in the range of about 2000–5000 psia and the Claus plant effluent stream is injected at above the minimum miscibility pressure of the dried hydrogenated stream for miscible flooding.

In accordance with a further aspect of the invention, the reservoir is a reservoir to be produced by immiscible displacement flooding.

In accordance with a further aspect of the invention, the pressurized dried hydrogenated stream introduced into the high pressure reservoir comprises in the range of about 3–75 mol % carbon dioxide, 0.5–10 mol % hydrogen sulfide, and the balance mostly nitrogen.

In accordance with a further aspect of the invention, Claus plant tailgas is disposed of by treating in accordance with the invention and injection into a subterranean reservoir.

BRIEF DESCRIPTION OF THE DRAWINGS

FIG. 1 shows that the use of nitrogen for pressurization causes an increase in saturation dewpoint pressure, which increases with an increase in the mole fraction of added gas as compared to gases also containing carbon dioxide. In contrast, the use of 100% carbon dioxide causes a decrease in the saturation dewpoint pressure. Curves for 10 mol % carbon dioxide, 50 mol % carbon dioxide, 70 mol % carbon dioxide, and 80 mol % carbon dioxide, the balance in each case being nitrogen, show that the presence of any amount of $CO_2$ in nitrogen diminishes the region where condensation will occur relative to the use of pure nitrogen and that the effect increases with the proportion of carbon dioxide. Thus, the presence of carbon dioxide in the pressurizing gas used in a gas condensate reservoir diminishes condensation and loss of liquids in the reservoir; conversely, the presence of carbon dioxide can increase production through revaporization of condensed liquids. Thus, it is highly advantageous for purposes of minimizing retrograde condensation that some carbon dioxide be present in the fluid introduced into the reservoir for pressure maintenance.

FIG. 2 indicates that the reduction in saturation dewpoint pressure in the presence of carbon dioxide is characteristic of both gas condensate reservoirs.

Referring now to FIG. 3, As shown in FIG. 3, a pressurizing gas can be introduced, for example, by line 10 and injection well 12 into reservoir 14 to maintain the pressure therein. Produced fluids can then be recovered from the reservoir 14 by production well 16 and provided to a hydrocarbon recovery zone 18 from which a hydrocarbon product can be produced as is known to those skilled in the art. Concomitantly with the production of the hydrocarbon product, an acid gas containing carbon dioxide and hydrogen sulfide can be produced and provided by line 20 to Claus thermal reaction zone 22. The Claus thermal reaction zone also has an oxidant introduced by line 24, for example, molecular oxygen, sulfur dioxide, or the like. The Claus thermal reaction zone 22 can be, for example, a Claus muffle furnace, a fire tube furnace, and the like. Generally, the Claus thermal reaction zone 22 functions for converting a portion of the hydrogen sulfide, preferably about ⅓, to sulfur dioxide for thermal or catalytic Claus reaction to form elemental sulfur.

Figure 1:
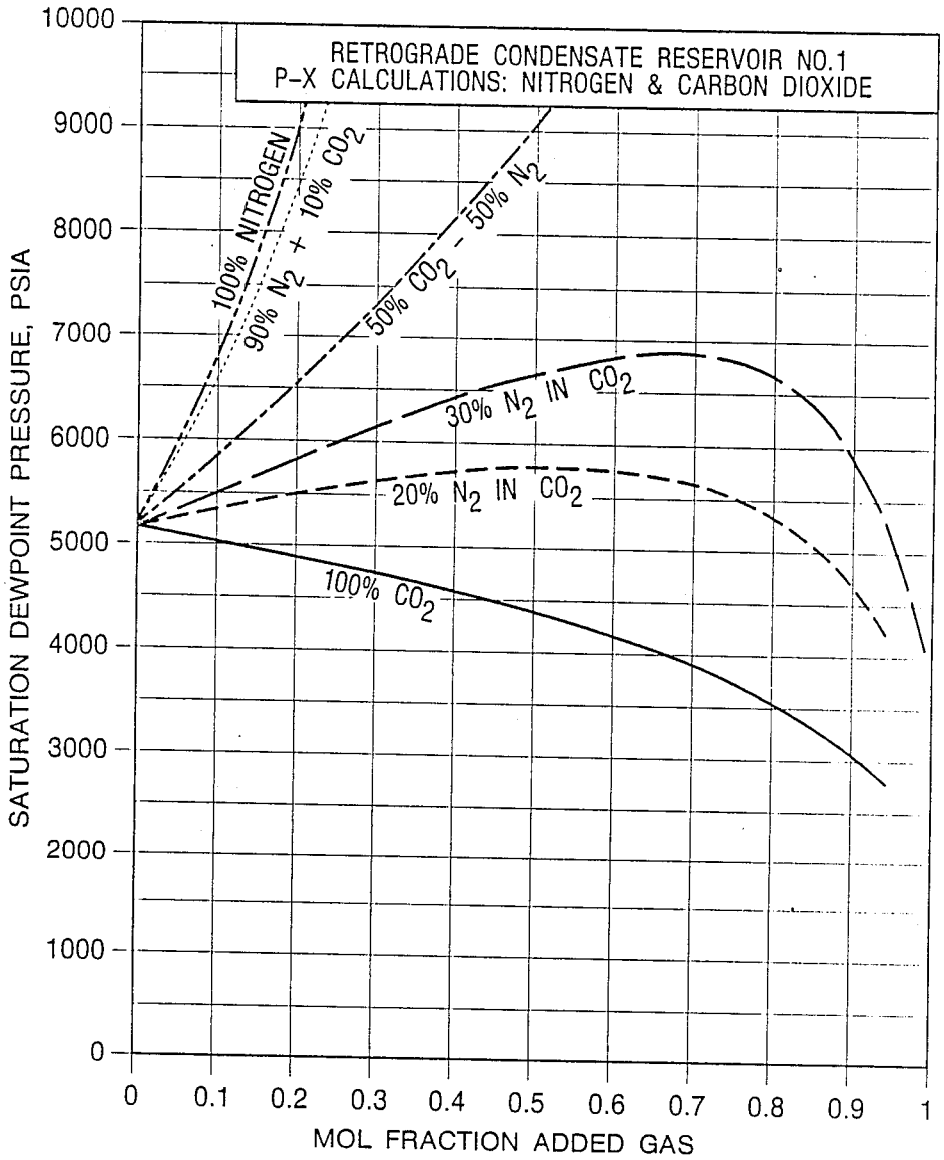
FIG. 1 shows the results from equation-of-state calculations for a first gas condensate reservoir indicating that the presence of carbon dioxide leads to saturation dewpoint pressure depression, thus suppressing retrograde condensation in a gas condensate reservoir. Since saturation dewpoint pressure is the pressure at which first condensation occurs, an increase in saturation dewpoint pressure means that a larger region exists in which condensation of liquids can occur.
Figure 2:
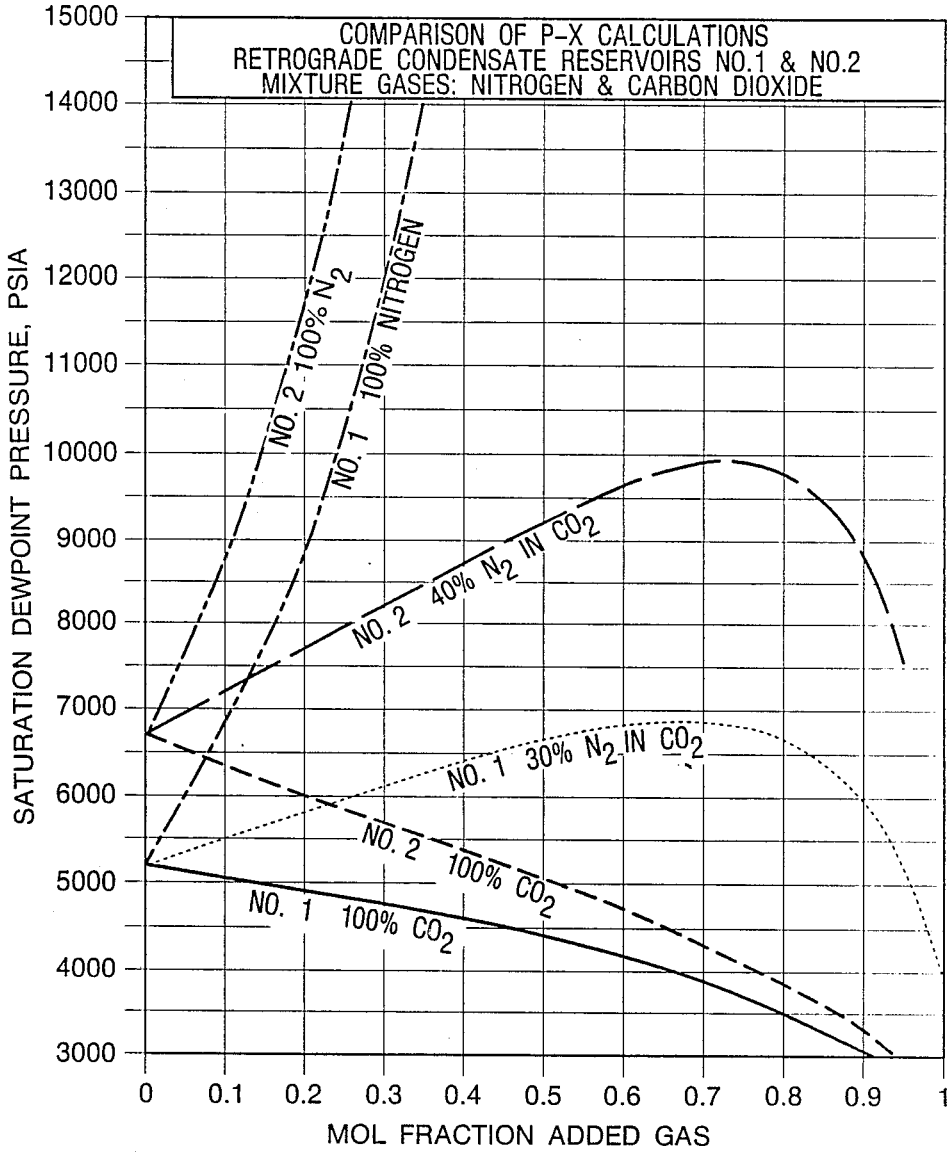
FIG. 2 shows results of equation-of-state calculations for the condensate reservoir shown in FIG. 1 and also for a second condensate reservoir.

In the Claus thermal reaction zone 22, acid gas and an oxidant can be reacted at a temperature in the range of about 1800°–2600° F. The effluent from the Claus thermal reaction zone can be cooled, for example, in a waste heat boiler, optionally passed through a first sulfur condenser to remove sulfur and fed into a Claus catalytic reaction zone 26 by line 24 at a temperature in the range, for example, of about 450°–650° F. In the Claus catalytic reaction zone 26, the effluent from a first catalytic reactor can be passed to a second sulfur condenser to remove additional sulfur. Also in the Claus catalytic reaction zone 26, the gas stream from such a second sulfur condenser can be reheated and passed to a second, and if desired, subsequent Claus catalytic reactors as is known in the art, operated above the sulfur dewpoint, or alternatively operated under conditions, including temperature, effective for depositing a preponderance of sulfur on the catalyst therein. The effluent from the Claus catalytic reaction zone 26 is removed by line 27 and contains predominantly nitrogen, for example, in the range of about 10 to about 80 mol % nitrogen, water, for example, in the range of about 20 to about 40 mol %, and carbon dioxide, for example, in the range of about 1 to about 50 mol %. In addition, minor amounts of hydrogen sulfide, sulfur dioxide, carbonyl sulfide, carbon disulfide, elemental sulfur, mercaptans, and the like may also be present. Typically, these minor components will not exceed more than about 1–3 mol % of the Claus plant effluent gas.

Operation of a Claus plant, including a thermal reaction zone and one or more Claus catalytic reaction zones is well known to those skilled in the art and further description here is not required. Similarly, hydrogenation of a Claus plant effluent stream, water removal from a hydrogenated stream, and compression of gas streams need only be briefly described as hereinafter set forth.

The treatment prior to injection of the Claus plant effluent into the reservoir comprises three basic steps: hydrogenation, water removal, and compression to about reservoir pressure in the case of gas condensate reservoirs, and to above the minimum miscibility pressure of the injected gas for miscible flooding, or to a suitable pressure for immiscible displacement flooding. For example, after hydrogenation in zone 28 and water removal in zone 30, preliminary compression can occur in pressurization zone 34 followed by subsequent pressurization to suitable injection pressures, for example, after final dehydration in zone 38.

In hydrogenation zone 28, substantially all sulfur compounds present in the tail-gas are converted to hydrogen sulfide. This step is necessary to prevent sulfur deposition on equipment, piping, and reservoir surfaces as the effluent stream is injected into the reservoir. This step also makes it possible to cool the gas stream and remove water without sulfur condensation and corrosion problems.

Thus, the sulfur containing compounds of the Claus plant gaseous effluent stream in line 27 can be converted to hydrogen sulfide in hydrogenation zone 28. The hydrogenation zone can be either catalytic or noncatalytic, although a catalytic hydrogenation zone is preferred. Useful catalysts are those containing metals of Groups VB, VIB, VIII, and the Rare Earth Series of the Periodic Table of the Elements, as published in Perry, *Chemical Engineers Handbook*, Fifth Edition, 1973. The catalyst may be supported or unsupported although catalysts supported on a silica, alumina, or silica alumina base are preferred. The preferred catalyst is one containing one or more of the metals cobalt, molybdenum, iron, chromium, vanadium, thorium, nickel, tungsten, and uranium. Particularly preferred are standard cobaltmolybdenum type hydrogenation catalysts, for example, United Catalyst Type 29-2 available from United Catalysts, Incorporation, Louisville, Ky., 40232.

The reducing equivalents, hydrogen and carbon monoxide, necessary for converting sulfur containing compounds to hydrogen sulfide in the hydrogenation zone can be provided from an external source or can be present within the Claus plant effluent stream. Preferably, the hydrogen can be present in the Claus plant effluent stream. However, if insufficient reducing equivalents are present, then, for example, a reducing gas generator can be used for the partial combustion of fuel gas to produce reducing equivalents in the form of hydrogen and carbon monoxide. Other methods of providing hydrogen will be readily apparent to those skilled in the pertinent arts.

The hydrogenation zone can be operated at a temperature in the range of about 450° F. to about 650° F. when a catalyst as described above is present. Preferably, the hydrogenation zone is operated at a temperature from about 580° F. to about 650° F. to provide adequate initiation and conversion of the sulfur containing compounds to hydrogen sulfide.

Following conversion of the sulfur containing compounds to hydrogen sulfide, the resulting hydrogen sulfide containing stream in line 29 can be cooled and water can be removed therefrom prior to downstream pressurization zone 34 to improve pressurization and deliverability. Thus, the resulting hydrogen sulfide containing stream can be introduced by line 29 into a cooling and water removal zone 30, which can comprise a contact condenser, for example, a quench tower effect for substantial temperature reduction of the stream therein, where it is contacted with, for example, cooled water to cool and to condense and remove water from the hydrogen sulfide containing stream. Alternatively, other methods known to those skilled in the art can be used to cool the stream in line 29 to remove water therefrom.

In a contact condenser, the hydrogen sulfide containing stream can preferably be contacted, for example, with water having a temperature in the range from about 40° F. to about 120° F. to condense water and remove such from the hydrogen sulfide containing stream.

Figure 3:
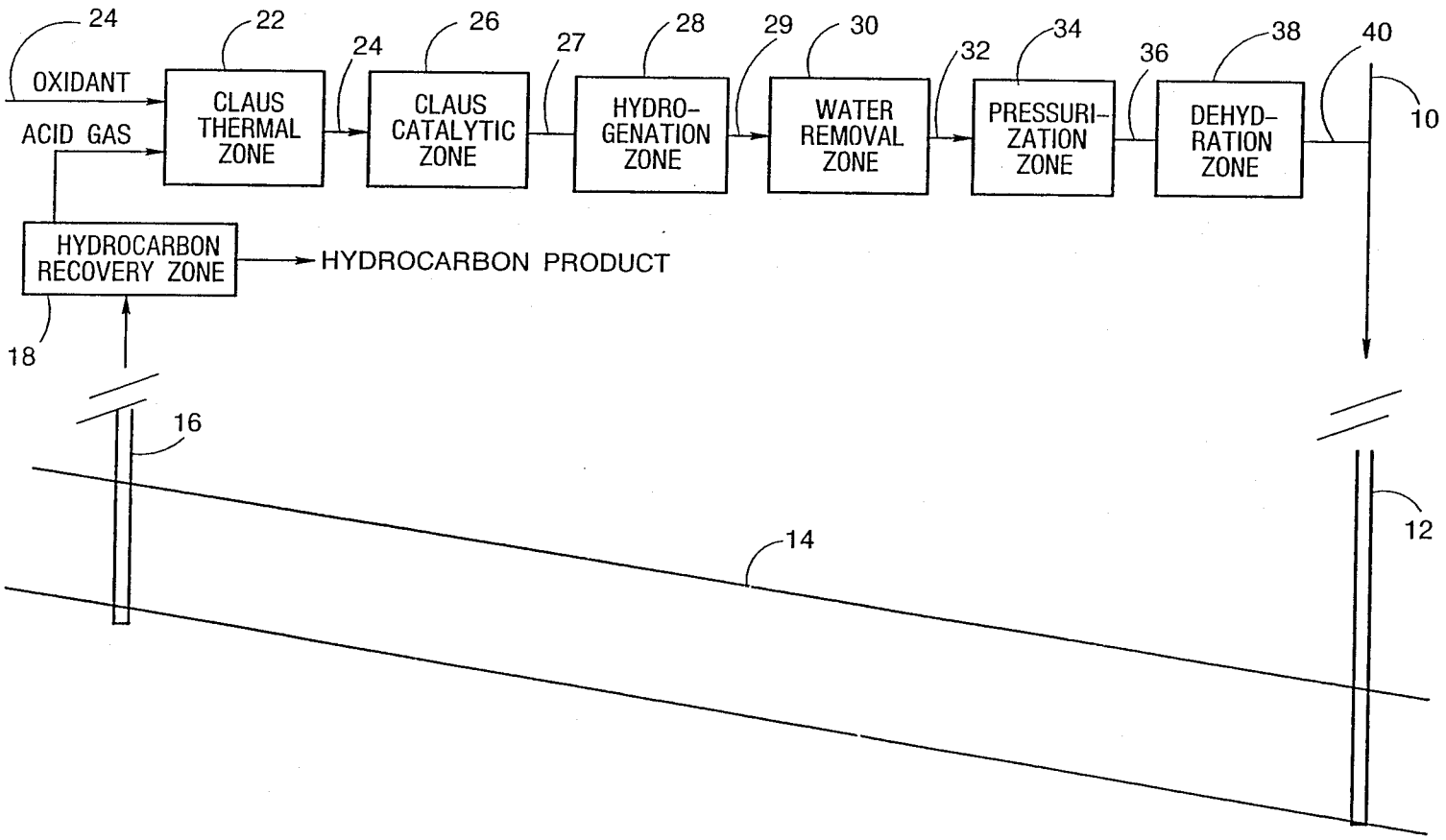
FIG. 3 shows, in accordance with the invention, a method for maintaining the pressure in a reservoir by use of a mixture of carbon dioxide and nitrogen containing gas.

The resulting dried hydrogen sulfide containing stream having a temperature in the range of about 40° to about 120° F. can then be provided by line 32 to a pressurization zone 34 where the stream is compressed, for example, to about 800 psia. Downstream of pressurization zone 34, the pressurized stream in line 36 can be subjected to a final dehydration in dehydration zone 38 using dehydration agents such as polyethylene glycol (PEG) and the like, as is known to those skilled in the art. The resulting stream can then be further pressurized in a zone not specifically shown in the FIG. 3 to a suitable pressure for injection by lines 40 and 10 into the reservoir 14, for example, to about 2000 psia or greater. The hydrogenated dried hydrogen sulfide containing stream, can contain, for example, in the range of about 3–75% carbon dioxide, 0.5–10 mol % hydrogen sulfide, and the balance mostly nitrogen.

From the foregoing, it will be appreciated that the advantages of the method of the instant invention include (1) treated tail-gas injection from a Claus sulfur recovery plant can often be initiated with a lower capital cost than a nitrogen injection plant; (2) treated tail-gas injection does not require the capital intensive tail-gas cleanup technology normally associated with tail-gas handling; (3) treated tail-gas injection will reduce or eliminate the tail-gas incineration operation of existing sulfur recovery plants, with resulting savings in fuel consumption; (4) treated tail-gas injection provides an excellent opportunity to increase reserves through a pressure maintenance project; (5) increased reserves may also be realized when compared to a nitrogen injection project because of the miscible components such as carbon dioxide and hydrogen sulfide in the tail-gas, together with the beneficial effect observed in minimizing retrograde condensation due to the presence of carbon dioxide; and (6) sulfur plant emissions will be substantially completely eliminated by reinjection of the offensive compounds such as hydrogen sulfide back into the subterranean reservoirs.

While the invention has been described as required in accordance with a preferred embodiment and in particular relation to the drawings attached hereto, it should be understood that other and further modifications, apart from those shown or suggested herein, may be made within the scope and spirit of the present invention which is therefore defined by the claims appended hereto.

What is claimed is:

1. A process for producing a reservoir comprising:

producing a Claus plant effluent stream comprising predominantly carbon dioxide, nitrogen, and water, and minor amounts of hydrogen sulfide and sulfur dioxide, from a gaseous stream comprising hydrogen sulfide and carbon dioxide by the steps of oxidizing a portion of the hydrogen sulfide to sulfur dioxide and reacting thus produced sulfur dioxide with a remaining portion of hydrogen sulfide and producing elemental sulfur which is condensed and removed;

hydrogenating substantially all sulfur species in the resulting Claus plant effluent stream to hydrogen sulfide;

removing water from the resulting hydrogenated stream;

pressurizing the resulting hydrogenated stream to about reservoir injection pressure; and injecting the resulting pressurized dried hydrogenated stream into the reservoir.

2. The Process of claim 1 wherein:

the reservoir is a gas condensate reservoir having a pressure of 5000 psia or greater; and the process comprises injecting the resulting pressurized dried hydrogenated stream into the reservoir for pressure maintenance.

3. The Process of claim 1 wherein the reservoir comprises a reservoir in the range of about 2000–5000 psia and the Claus plant effluent stream is injected at above the minimum miscibility pressure of said dried hydrogenated stream for miscible flooding.

4. The Process of claim 1 wherein the resulting pressurized dried hydrogenated stream introduced into the reservoir comprises in the range of about 3–75 mol % carbon dioxide, 0.5–10 mol % hydrogen sulfide, and the balance mostly nitrogen.

5. A process for disposing of effluent tailgas from a Claus process sulfur recovery plant comprising:

producing a Claus plant effluent stream comprising predominantly carbon dioxide, nitrogen, and water, and minor amounts of hydrogen sulfide and sulfur dioxide, from a gaseous stream comprising hydrogen sulfide and carbon dioxide by the steps of oxidizing a portion of the hydrogen sulfide to sulfur dioxide and reacting thus produced sulfur dioxide with a remaining portion of hydrogen sulfide and producing elemental sulfur which is condensed and removed;

hydrogenating substantially all sulfur species in the resulting Claus plant effluent stream to hydrogen sulfide;

removing water from the hydrogenated stream;

pressurizing the hydrogenated stream to about reservoir injection pressure; and injecting the resulting pressurized dried hydrogenated stream into a subterranean reservoir.

* * * * *